US005873635A

United States Patent [19]

Merrick

[11] Patent Number: 5,873,635

[45] Date of Patent: Feb. 23, 1999

[54] CHILD SEAT HARNESS CLIP WITH WEB LOCK

[75] Inventor: David D. Merrick, Cicero, Ind.

[73] Assignee: Indiana Mills & Manufacturing, Inc., Westfield, Ind.

[21] Appl. No.: 820,016

[22] Filed: Mar. 18, 1997

Related U.S. Application Data

[63] Continuation-in-part of Ser. No. 64,898, Jan. 14, 1997, Pat. No. Des. 389,426.

[51] Int. Cl.[6] ..... A47C 31/00; A44B 1/04

[52] U.S. Cl. ..... 297/484; 297/250.1; 24/171; 24/194

[58] Field of Search ..... 24/163 K, 171, 24/194; 297/250.1, 464, 484, 473

[56] References Cited

U.S. PATENT DOCUMENTS 4,679,282 7/1987 Feng .
4,791,709 12/1988 Fildan .
4,916,779 4/1990 Tarada et al. .
4,928,364 5/1990 Ikeda .
5,031,962 7/1991 Lee .
5,084,946 2/1992 Lee .
5,170,539 12/1992 Lundstedt et al. .
5,286,090 2/1994 Templin et al. .
5,380,067 1/1995 Turvill et al. .
5,471,714 12/1995 Olson .
5,561,891 10/1996 Hsieh .

*Primary Examiner*—Milton Nelson, Jr.
*Attorney, Agent, or Firm*—Woodard, Emhardt, Naughton, Moriarty & McNett

[57] ABSTRACT

A quick disconnect connector mountable to a pair of shoulder webs on a child seat. The connectors each include a pair of aligned slots slidably receiving a shoulder web. The first connector has three cantilevered arms extendable into a cavity in the second connector. Two of the arms are contactable against a cantilevered movable web lock on the second connector. The third arm includes a ledge lockable against a stop edge on the second connector. The web lock has a distal end movable downwardly beneath the other two arms locking the second web in place when the connectors are mated and locked together.

13 Claims, 5 Drawing Sheets

CHILD SEAT HARNESS CLIP WITH WEB LOCK

REFERENCE TO RELATED APPLICATIONS

This application is a continuation-in-part of the commonly owned U.S. Design patent application Ser. No. 29/064,898; filed on Jan. 14, 1997 now U.S. Pat. No. 389,426 by the inventor of the present application and entitled "Contoured Harness Clip".

BACKGROUND OF THE INVENTION

1. Field of the Invention

This invention is in the field of vehicle child seats integrated into a vehicle passenger seat or separate therefrom and more specifically a child seat having a connecting device to removably secure the seat harness webs together.

2. Description of the Prior Art

A child restraint system may be built into a vehicle passenger seat or may be included within a child seat restable upon the vehicle seat. A variety of different types of harness systems are available such as disclosed in the commonly owned U.S. Pat. Nos. 5,286,090 and 5,031,962. Typically, the restraint system includes a pair of webs extendable downwardly over the shoulders and against the chest of the child to a pair of tongues or a single tongue, in turn, lockingly engaged with a buckle secured to the seat. In order to position the webs together across the child's chest, quick disconnect connectors are utilized such as shown in the commonly owned U.S. Pat. No. 5,084,946.

In my co-pending U.S. patent application Ser. No. 08/623,695; filed Apr. 15, 1996, I disclose a pair of web socks attached to mating quick disconnect connectors for securing the webs together. The combined multi-sock and web connector thereby reduces the number of steps required to adjust the harness to the particular child. Likewise, such combination is desirable to more securely hold the socks and connector at the desired location along the length of the webs while at the same time ensuring that at least a portion of each web is parallel to each other thereby positioning the webs accurately across the child's chest.

In lieu of utilizing the web sock design, I have disclosed herein a pair of mating quick disconnect connectors designed to limit relative motion between one of the connectors and the associated web when the connectors are locked together thereby also limiting relative motion between the webs.

SUMMARY OF THE INVENTION

One embodiment of the present invention includes a connector for releasably holding a first web and a second web together while limiting motion of the second web. The connector includes a first guide for receiving a first web with a first lock and a second guide for receiving a second web with a second lock. The first lock and second lock are releasably mateable and lockable together securing the first guide and the second guide together. A movable web lock mounted to the second guide is positionable against the second web when mounted thereto when the first lock and the second lock are mated and locked together limiting web motion between the second guide and the second web but movable to allow the second web to move relative to the second guide when the first guide and second guide are unlocked and separated.

It is an object of the present invention to provide a new and improved connector for releasably holding a pair of webs together while limiting motion of one of the webs.

A further object of the present invention is to provide a new and improved child vehicle restraint system.

Yet another object of the present invention is to provide a combined web guide and connector to limit lateral movement of one child restraint web relative to another child restraint web.

Related objects and advantages of the present invention will be apparent from the following description.

DESCRIPTION OF THE PREFERRED EMBODIMENT

Figure 1:
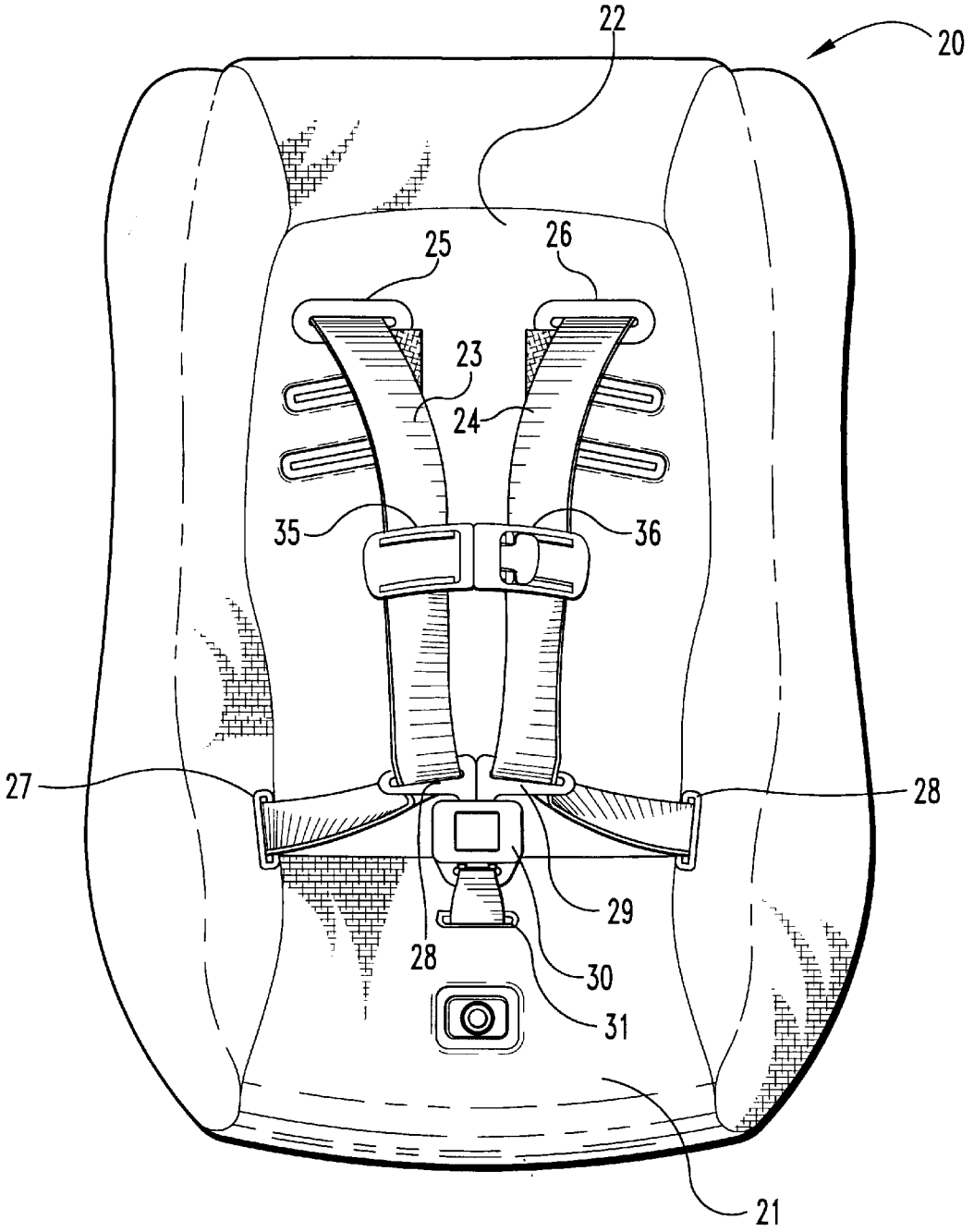
FIG. 1 is a front view of a child seat having a pair of restraint webs with the quick disconnect connectors incorporating the present invention mounted thereto.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the preferred embodiment of the present invention including a child seat 20 with guides 35 and 36. Seat 20 includes a bottom portion 21 and back portion 22 upon and against which the child rests. A pair of restraint webs 23 and 24 extend through slots 25 and 26 provided in back portion 22 and have first opposite ends secured behind or beneath the seat. Likewise, the second ends of webs 23 and 24 extend through slots 27 and 28 of the seat and are fixedly secured thereto. A pair of seat belt buckle tongues 28 and 29 are slidably mounted respectively to each web 23 and 24 and are lockingly engageable with a seat belt buckle 30 attached to a web extending via slot 31 through the bottom portion 21 with the opposite end of the web being suitably mounted. Such a seat described is well known in the art and may be, for example, the seat disclosed in the commonly owned U.S. Pat. No. 5,380,066, herewith incorporated by reference.

Webs 23 and 24 are held in fixed spaced apart relationship by a pair of guides or connectors 35 and 36 releasably mateable and lockable together. Each connector 35 and 36 is produced from a relatively rigid plastic material and includes a slot through which the associated web extends.

Figure 7:
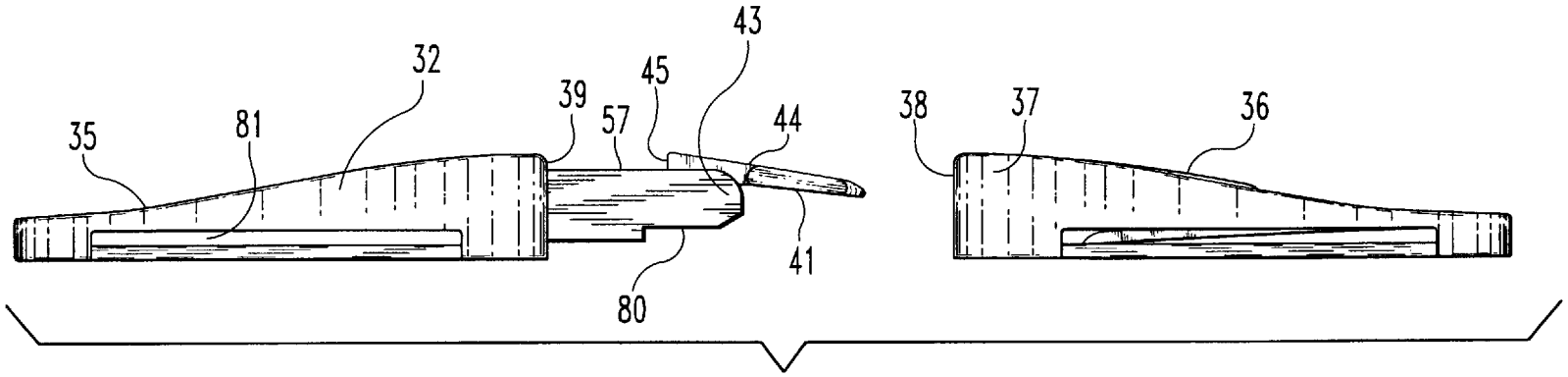
FIG. 7 is an end view of the connectors of FIG. 5.
Figure 8:
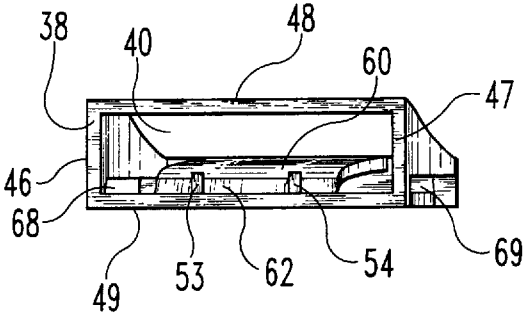
FIG. 8 is a cross-sectional view taken along the line 8—8 of FIG. 5 and viewed in the direction of the arrows.

Male connector 35 (FIG. 7) includes a main body 32 having an end 39 positionable adjacent end 38 of the main body 37 of female connector 36. A cavity 40 (FIG. 8) extends through end 38 to receive arms 57 through 59 (FIG.

5) of connector 35. Arm 59 includes a distal end 41 extending across the distal ends 42 and 43 of arms 58 and 57. Arm 59 extends outwardly of ends 42 and 43 and has a generally plate shaped configuration with the top surface 44 (FIG. 7) of end 41 slopping downwardly as the arm extends further from end 39 of connector 35. A ledge or stop surface 45 is formed on arm 59 extending laterally and perpendicularly between and relative to arms 57 and 58 and is positioned between end 39 of the connector and the distal ends 42 and 43. Ledge 45 can be arranged at angles in addition to ninety degrees relative to arm 59 to achieve different pull apart forces.

Figure 2:
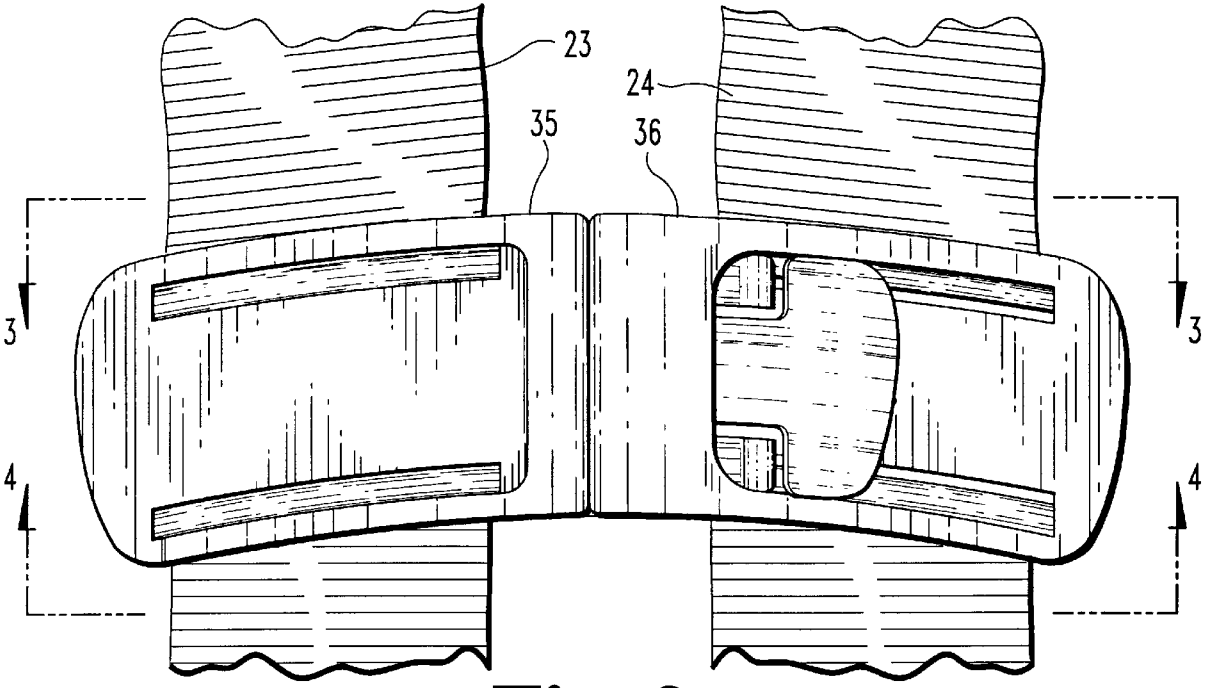
FIG. 2 is an enlarged fragmentary front view of the restraint webs and connectors.
Figure 4:
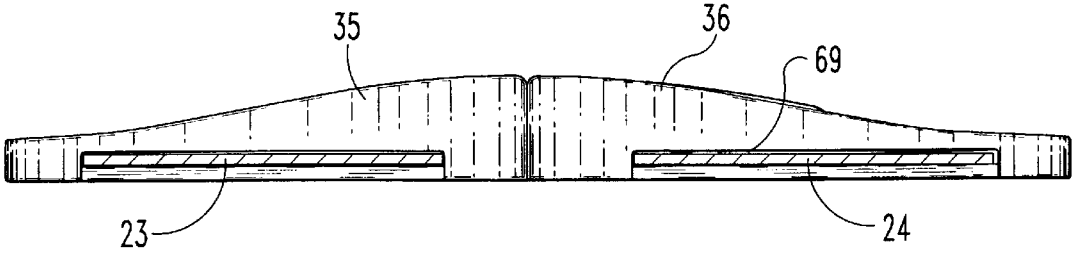
FIG. 4 is a cross-sectional view taken along the line 4—4 of FIG. 2 and viewed in the direction of the arrows.

Cavity 40 (FIG. 8) of connector 36 is formed by a pair of side walls 46 and 47 integrally joined to a top wall 48 and bottom wall 49 of the connector. Top wall 48 includes a stop surface or edge 50 (FIG. 5) extending across the width of the connector. Insertion of arm 59 into cavity 40 while forcing connector 35 and 36 together results in the positioning of ledge 45 immediately adjacent and against edge 50 (FIG. 5) thereby locking the connectors together as depicted in FIG. 2. Arm 59 is cantilevered to main body 32 of connector 35 and is relatively thin thereby enabling the user to flex arm 59 to force distal end 41 downwardly as viewed in FIG. 7 thereby positioning arm 59 between walls 48 and 49 (FIG. 8) and allowing distal end 41 to be forced through opening 40.

A movable web lock 60 has a first end portion 61 (FIG. 5) cantileverly mounted to the main body of connector 36. The free or distal end 62 (FIG. 8) of web lock 60 is positioned beneath top wall 48 and terminates between edge 50 (FIG. 5) and end 38. The movable web lock is a movable element or arm integrally attached to the main body of the connector and movable against web 24 to limit movement between the web and connector 36. Movable web lock 60 is cantilevered to connector 36 and is relatively thin allowing movement in a direction perpendicular to web 24. A pair of ridges 53 and 54 (FIG. 8) extend upwardly from bottom wall 49 to prevent arm 59 from extending beneath movable web lock 60.

Figure 5:
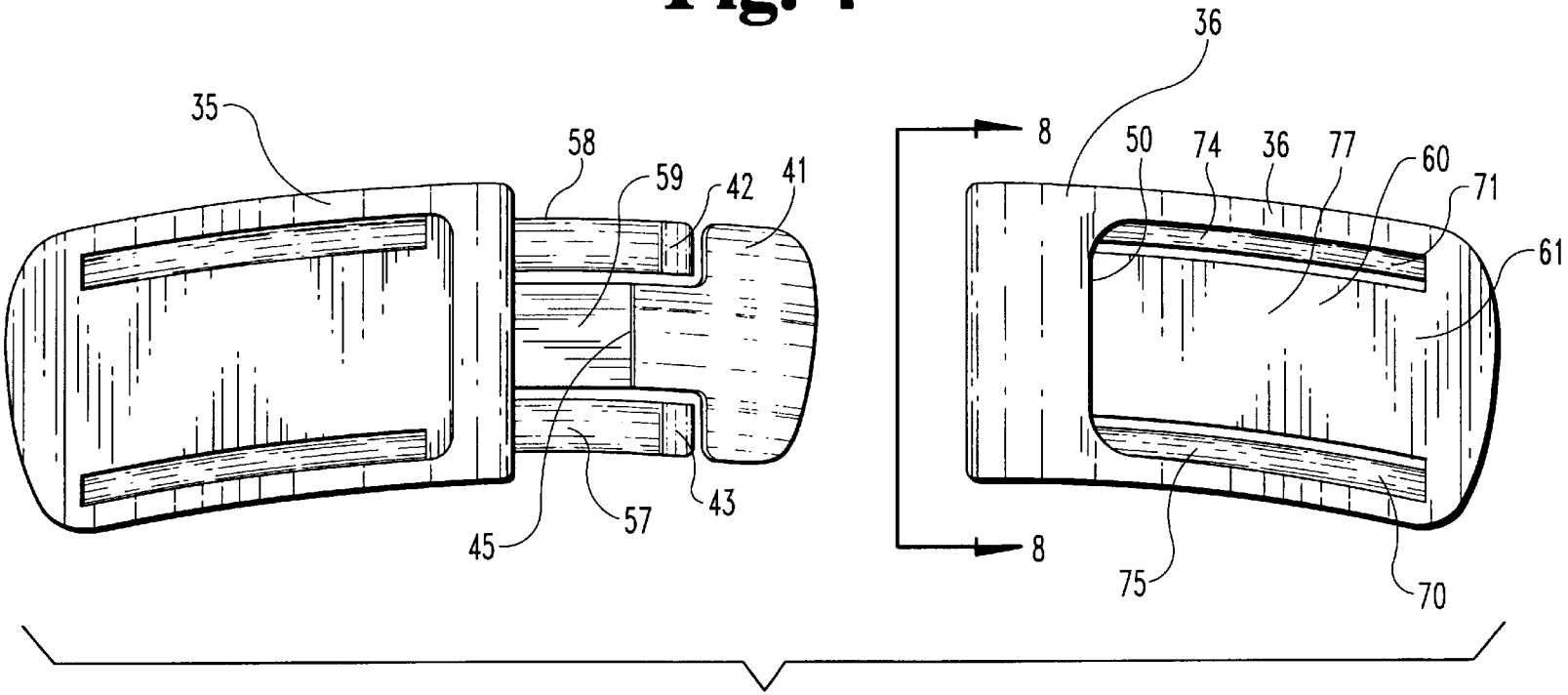
FIG. 5 is the same view as FIG. 2 only showing the connectors unlocked and the webs removed therefrom.
Figure 6:
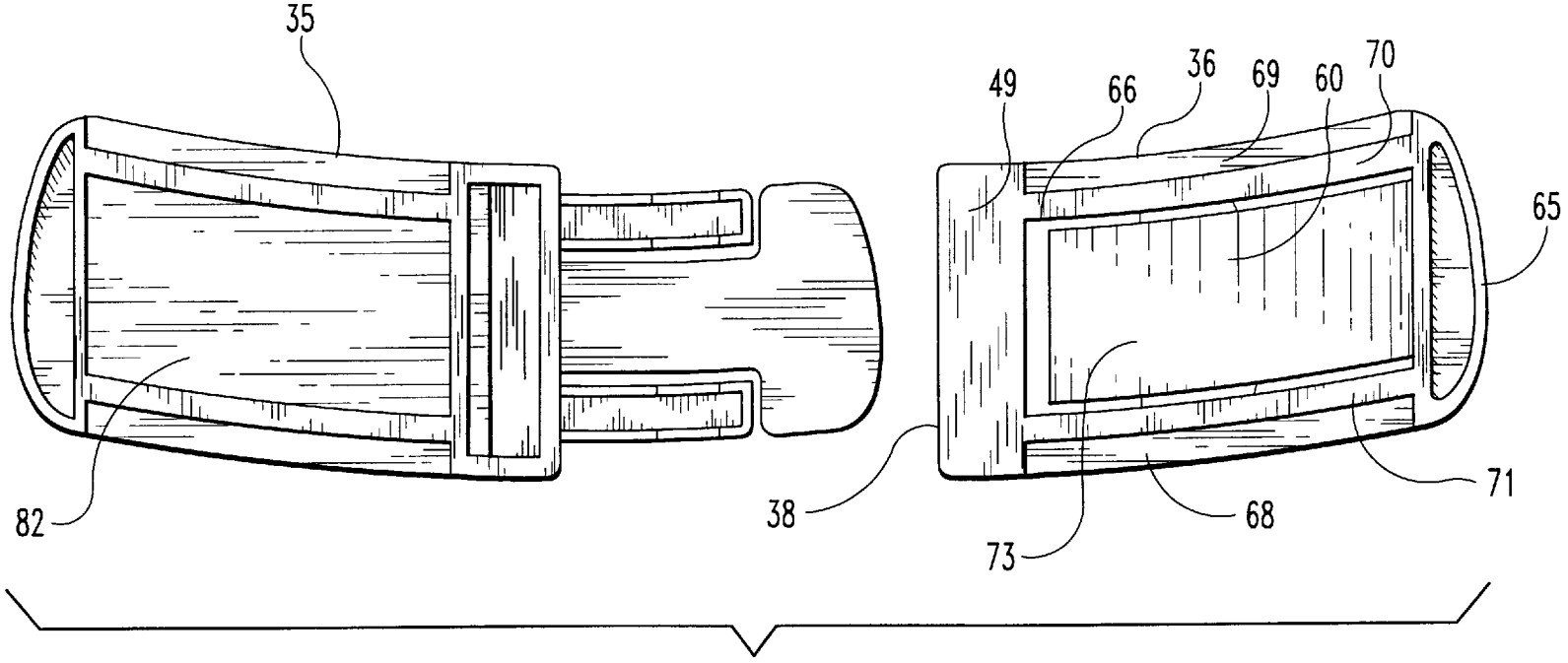
FIG. 6 is a rear view of the connectors of FIG. 5.

Bottom wall 49 of connector 36 (FIG. 6) extends from end 38 of the connector to the opposite end 65; however, a portion of the bottom wall is removed forming a rectangular opening 66 through which arm 60 may extend. Opening 66 also extends through top wall 48 forming edge 50 (FIG. 5). Further, the longitudinally extending bottom comer edge formed between bottom wall 49 and side wall 46 and between bottom wall 49 and side wall 47 is removed forming a pair of aligned web slots 68 and 69 through which web 24 extends. The web has been removed from FIGS. 5–8 to more clearly illustrate construction of the connectors. Slots 68 and 69 extend the length of opening 66 thereby forming the bottom wall 49 into a pair of spaced apart walls 70 and 71. Web 24 extends through slots 68 and 69 and is positioned between the downwardly facing surface 73 (FIG. 6) of element 60 and the upwardly facing surfaces 74 and 75 (FIG. 5) respectively of walls 71 and 70.

Distal ends 42, 43 of arms 58 and 57 (FIG. 5) contact the upwardly facing surface 77 (FIG. 5) of movable web lock 60 as arms 58, 57 are inserted into opening 40 forcing the distal end 62 (FIG. 8) of movable web lock 60 downwardly against web 24 and, in turn, forcing the web against the upwardly facing surfaces 74 and 75 (FIG. 5) of walls 71 and 70 and also positioning end 62 of web lock 60 beneath distal ends 42 and 43 of arms 58 and 57 as arms 58 and 57 are fully inserted into opening 40.

Figure 3:
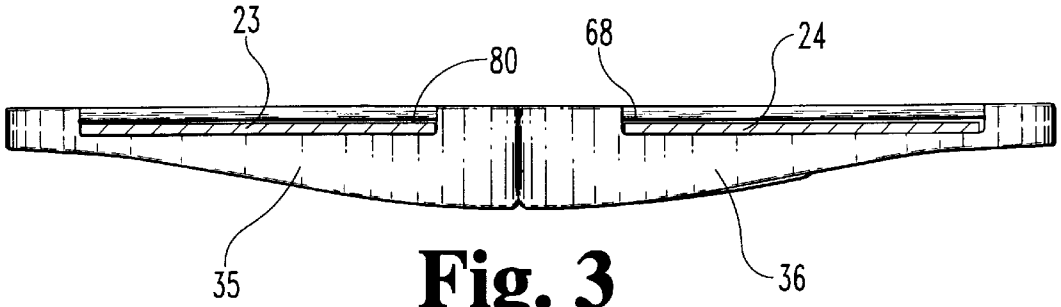
FIG. 3 is a cross-sectional view taken along the line 3—3 of FIG. 2 and viewed in the direction of the arrows.

Connector 35 likewise has the longitudinally extending lower edges removed from the corner between the bottom and side walls of the main body of the connector forming a pair of web slots 80 (FIG. 3) and 81 (FIG. 7) through which web 23 extends. The bottom wall 82 (FIG. 6) does not include a movable element such as element 73 and thus connector 35 may be moved along the length of web 23 at all times. Once, however, connector 35 and 36 are locked and secured together, relative motion between web 24 and connector 36 is prevented with the result that connector 35 has a stationary position on web 23. Slots 68, 69, 80, and 81 form a pair of guides for receiving webs 23 and 24.

The distal ends 42 and 43 of arms 58 and 57 (FIG. 7) include an indented lower edge for slipping over end 62 (FIG. 8) of movable web lock 60 when arms 57–59 are extended into opening 40. For example, end 43 (FIG. 7) of arm 57 has an indented lower edge 80. Likewise, distal end 42 (FIG. 5) has a similar indented lower edge. Thus, as end 41 of arm 59 is extended into opening 40, ends 42 and 43 of arms 58 and 59 contact the upwardly facing surface 77 of movable element 60 forcing the distal end 62 of the movable element downwardly to a position beneath arms 57 and 58 which are fully extended into opening 40. Once ledge 45 moves past edge 50, distal end 41 of arm 59 snaps upwardly under its normal bias being apart from web lock 60 allowing the upwardly facing surface 77 of the web lock 60 located at the distal end 62 thereof to rest beneath and adjacent the indented portions 80 of arms 57 and 58. The spacing between the upwardly facing surfaces 74 and 75 of walls 71 and 70 to the lower surface 73 of web lock 60 is such that the web extending therebetween is held securely thereto. That is, indented portions 80 of arms 57 and 58 force web lock 60 sufficiently downward to hold web 24 tightly between the lower surface of the web lock and surfaces 74 and 75 whenever connectors 35 and 36 are locked together.

Arm 59 has a normal bias to position ledge 45 against stop edge 50 when fully inserted into cavity 40. To unlock the connectors, end 41 is forced downwardly until arm 59 is beneath wall 48 (FIG. 8) and ledge 45 is spaced apart from edge 50. Arms 57–59 may then be pulled from cavity 40. Since distal ends 42 and 43 of arms 58 and 57 are no longer atop and against web lock 60, the web lock no longer holds web 24 against surfaces 74 and 75 allowing connector 36 to be moved relative to web 24. When the connectors are locked together, relative motion between web 24 and connector 36 is prevented and webs 23 and 24 are held in fixed spaced apart relationship. Thus, relative motion between the webs is limited in that webs 23 and 24 cannot move apart.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A connector for releasably holding a first web and a second web together while limiting motion of the second web comprising:

a first guide for receiving a first web, said first guide including a first lock;

a second guide for receiving a second web, said second guide including a second lock with said first lock and said second lock releasably mateable and lockable together securing said first guide and said second guide together, and, a movable web lock mounted to said second guide and positionable against said second web when mounted thereto when said first lock and said second lock are mated and locked together limiting web motion between said second guide and said second web but movable to allow said second web to move relative to said second guide when said first guide and second guide are unlocked and separated;

said first lock includes a first cantilevered arm and said second lock includes a cavity with said arm extending into said cavity when said first lock and said second lock are locked together, said first guide includes a second cantilevered arm with said cavity sized to receive said second cantilevered arm, said first guide and said second guide each include a main body through which said first web and said second web extend, said second cantilevered arm contacting and moving said movable web lock against said second web when said second cantilevered arm is inserted in said cavity.

2. The connector of claim 1 wherein:

said first cantilevered arm and said second cantilevered arm extend from said first guide whereas said cavity is located in said second guide, said movable web lock is a movable element cantilevered on said second guide.

3. The connector of claim 2 wherein:

said first cantilevered arm includes a finger engageable distal end which may be depressed to unlock said first lock from said second lock and allow said movable element to release said second web.

4. The connector of claim 3 wherein:

said second cantilevered arm engages said movable element as said first cantilevered arm and said second cantilevered arm are extended into said cavity moving said movable element beneath said second cantilevered arm which forces said movable element to hold said second web relative to said second guide.

5. The connector of claim 4 wherein:

said first guide and said second guide include cooperative stop means on said first cantilevered arm and said second guide to limit movement of said first cantilevered arm relative to said second guide until said distal end is depressed.

6. The connector of claim 5 wherein:

said first guide includes ridges thereon to limit movement of said first cantilevered arm relative to said movable web lock.

7. The connector of claim 6 wherein:

said second guide includes aligned slots formed thereon through which said second web extends, said movable element is located between said aligned slots.

8. A device for limiting motion between a first shoulder web and a second shoulder web on a vehicle child seat comprising:

a first guide slidably mountable to a first shoulder web, said first guide including a first lock;

a second guide slidably mountable to a second shoulder web, said second guide including a second lock with said first lock and said second lock releasably mateable and lockable together, and, a movable member mounted to said second guide and extending adjacent said second shoulder web when mounted thereto, said first lock and said second lock are mateable together limiting web motion between said first shoulder web and said second shoulder web and between said second guide and said second shoulder web but allowing said second shoulder web to move relative to said second guide when said first guide and second guide are unlocked and separated, said first lock includes a first cantilevered arm and said second lock includes a cavity with said arm extendable into said cavity when said first lock and said second lock are locked together, said first lock includes a second cantilevered arm with said cavity sized to receive said second cantilevered arm, said first guide and said second guide include a main body with slots through which said first shoulder web and said second shoulder web extend, said second cantilevered arm touching and moving said movable member against said second shoulder web when said second cantilevered arm is inserted in said cavity.

9. The device of claim 8 wherein:

said first guide is slidable on said first web at all times whereas said second guide is slidable on said second web only when said first lock is unlocked from said second lock.

10. A connector for releasably holding a first web and a second web together while limiting motion of the second web comprising:

a first guide for receiving a first web, said first guide including a first lock;

a second guide for receiving a second web, said second guide including a second lock with said first lock and said second lock releasably mateable and lockable together securing said first guide and said second guide together, and, a movable web lock mounted to said second guide and positionable against said second web when mounted thereto when said first lock and said second lock are mated and locked together limiting web motion between said second guide and said second web but movable to allow said second web to move relative to said second guide when said first guide and second guide are unlocked and separated;

said first lock includes a first cantilevered arm and said second lock includes a cavity with said arm extending into said cavity when said first lock and said second lock are locked together, said first guide and said second guide each include a main body through which said first web and said second web extend respectively, said first cantilevered arm contacting and moving said movable web lock against said second web when said first cantilevered arm is inserted in said cavity.

11. A device for limiting motion between a first shoulder web and a second shoulder web on a vehicle child seat comprising:

a first guide slidably mountable to a first shoulder web, said first guide including a first lock;

a second guide slidably mountable to a second shoulder web, said second guide including a second lock with said first lock and said second lock releasably mateable and lockable together, and, a movable member mounted to said second guide and extending adjacent said second shoulder web when mounted thereto, said first lock and said second lock are mateable together limiting web motion between said first shoulder web and said second shoulder web and between said second guide and said second shoulder web but allowing said second shoulder web to move relative to said second guide when said first guide and second guide are unlocked and separated, said first lock includes a first cantilevered arm and said second lock includes a cavity with said arm extendable into said cavity when said first lock and said second lock are locked together, said first guide and said second guide each include a main body with slots through which said first shoulder web and said second shoulder web extend respectively, said first cantilevered arm touching and positioning said movable member against said second shoulder web when said first cantilevered arm is inserted in said cavity.

12. A seat with shoulder webs for holding a child comprising:

a child seat for holding a child in a vehicle;

a first shoulder web and a second shoulder web extendable downwardly over a child positioned in said seat;

a buckle tongue combination mounted on said seat and connected to said first shoulder web and said second shoulder web operable to releasable lock said first shoulder web and said second shoulder web relative to said seat;

a first guide slidably mounted to said first shoulder web, said first guide including a first lock;

a second guide slidably mounted to said second shoulder web, said second guide including a second lock with said first lock and said second lock releasably mateable and lockable together, and, a movable web lock mounted to said second guide and movable against said second shoulder web when said first lock and said second lock are mated and locked together limiting web motion between said second guide and said second shoulder web and between said first shoulder web and said second shoulder web but allowing said second shoulder web to move relative to said second guide when said first guide and said second guide are unlocked and separated, said first guide includes a first cantilevered arm and said second guide includes a cavity with said arm extending into said cavity when said first lock and said second lock are locked together, said first guide includes a second cantilevered arm with said cavity sized to receive said second cantilevered arm; said first guide and said second guide each include a main body with a slot through which said first shoulder web and said second shoulder web extend, said second cantilevered arm touching and positioning said movable web lock against said second shoulder web when said second cantilevered arm is inserted in said cavity.

13. A seat with shoulder webs for holding a child comprising:

a child seat for holding a child in a vehicle;

a first shoulder web and a second shoulder web extendable downwardly over a child positioned in said seat;

a buckle tongue combination mounted on said seat and connected to said first shoulder web and said second shoulder web operable to releasable lock said first shoulder web and said second shoulder web relative to said seat;

a first guide slidably mounted to said first shoulder web, said first guide including a first lock;

a second guide slidably mounted to said second shoulder web, said second guide including a second lock with said first lock and said second lock releasably mateable and lockable together, and, a movable web lock mounted to said second guide and movable against said second shoulder web when said first lock and said second lock are mated and locked together limiting web motion between said second guide and said second shoulder web and between said first shoulder web and said second shoulder web but allowing said second shoulder web to move relative to said second guide when said first guide and said second guide are unlocked and separated, said first guide includes a first cantilevered arm and said second guide includes a cavity with said arm extending into said cavity when said first lock and said second lock are locked together, said first guide is slidable on said first web at all times whereas said second guide is slidably on said second web only when said first lock is unlocked from said second lock, said first cantilevered arm contacting and moving said movable web lock against said second shoulder web when said first cantilevered arm is inserted in said cavity.

* * * * *